US008226081B2

(12) United States Patent
Wang

(10) Patent No.: US 8,226,081 B2
(45) Date of Patent: Jul. 24, 2012

(54) PAPER TRAY OF PRINTER

(75) Inventor: Chih-Hwa Wang, Taipei County (TW)

(73) Assignee: Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/209,674

(22) Filed: Aug. 15, 2011

(65) Prior Publication Data

US 2011/0298173 A1 Dec. 8, 2011

Related U.S. Application Data

(62) Division of application No. 12/574,099, filed on Oct. 6, 2009, now Pat. No. 8,052,138.

(30) Foreign Application Priority Data

Sep. 1, 2009 (TW) ..... 98129454 A

(51) Int. Cl.
*B65H 3/06* (2006.01)

(52) U.S. Cl. ..... 271/117; 271/118; 271/110; 271/111; 271/171

(58) Field of Classification Search ..... 271/110, 271/111, 117, 118
See application file for complete search history.

(56) References Cited

U.S. PATENT DOCUMENTS

| | | | | |
|---|---|---|---|---|
| 4,098,501 | A * | 7/1978 | Tani et al. | 271/117 |
| 4,231,566 | A * | 11/1980 | Suzuki | 271/117 |
| 4,351,519 | A * | 9/1982 | Jendrick | 271/117 |
| 4,529,189 | A * | 7/1985 | Konishi et al. | 271/22 |
| 5,060,926 | A * | 10/1991 | Murai et al. | 271/111 |
| 5,060,927 | A * | 10/1991 | Sugiura | 271/117 |
| 5,975,517 | A * | 11/1999 | Lim | 271/117 |
| 8,052,138 | B2 * | 11/2011 | Wang | 271/117 |
| 2007/0158901 | A1 * | 7/2007 | Lee | 271/171 |
| 2011/0298174 | A1 * | 12/2011 | Wang | 271/226 |

* cited by examiner

*Primary Examiner* — Kaitlin Joerger
*Assistant Examiner* — Ernesto Suarez
(74) *Attorney, Agent, or Firm* — J.C. Patents

(57) ABSTRACT

A paper tray of printer is provided, which includes a paper tray body, a slide shaft, a first pick arm, a second pick arm and a paper width guide. The first pick arm is fixed on the slide shaft, and the second pick arm is slidely disposed on the slide shaft. The paper width guide is disposed on the paper tray body and is connected to the second pick arm through a linkage device to drive the second pick arm, so that a position of the second pick arm varies along with a position of the paper width guide. Accordingly, an interval between the first pick arm and the second pick arm can be varied along with a size of a paper, so as to avoid paper skew when the paper is fed.

8 Claims, 14 Drawing Sheets

PAPER TRAY OF PRINTER

CROSS-REFERENCE TO RELATED APPLICATION

This application is a divisional of and claims the priority benefit of U.S. application Ser. No. 12/574,099, filed on Oct. 6, 2009, which claims the priority benefit of Taiwan application Ser. No. 98129454, filed on Sep. 1, 2009. The entirety of each of the above-mentioned patent applications is hereby incorporated by reference herein and made a part of this specification.

BACKGROUND OF THE INVENTION

1. Field of the Invention

The present invention relates to a paper tray of a printer. More particularly, the present invention relates to a paper tray having two pick arms.

2. Description of Related Art

Along with the widespread of information products, various information products are developed, and the information products have a general trend of diversity. However, regarding image display methods of a computer, displays and printers are mainly used as image output devices. Wherein, the printers can be approximately categorized into three types of point matrix printers, inkjet printers and laser printers. Taking the laser printer as an example, it has advantages of high printing quality, fast printing speed, and low average cost of consumables, etc., so that the laser printer is one of the popular printers in the market.

However, during a paper picking process of the printer, a phenomenon of paper skew or paper jam is occurred due to a mechanical structure of the printer and differences of paper properties. To correct the problem of paper skew, a paper feeding device of the printer may perform actions to adjust the paper, by which the paper is repeatedly slid to adjust a position thereof or a mechanical structure is used to mitigate the problem of paper skew or paper jam.

A paper tray of the printer generally has a pick roller to assist the paper picking, so that the paper can be smoothly fed to the printer for printing. Generally, the paper tray only has one set of the pick roller, and the pick roller is fixed in a specific position in the paper tray, so that it cannot be adjusted according to a size or a position of the paper. When a paper or a printing medium of a great size is used, since the position of the pick roller is not located in the middle of the paper, the problem of paper skew is probably occurred.

SUMMARY OF THE INVENTION

The present invention is directed to a paper tray of a printer, which has two sets of pick roller, wherein one set of the pick roller can be moved according to a position of a paper width guide, so as to adjust a position of the pick roller to fit papers of different sizes, and avoid a phenomenon of paper skew.

The present invention provides a paper tray of a printer, which includes a paper tray body, a first slide shaft, a first pick arm, a second pick arm and a paper width guide. The first slide shaft is connected to the paper tray body. The first pick arm has a first pick roller and is fixed on the first slide shaft. The second pick arm has a second paper roller and is slidely disposed on the first slide shaft. The paper width guide is disposed on the paper tray body and is connected to the second pick arm through a linkage device to drive the second pick arm, so as to adjust a position of the second pick arm.

In an embodiment of the present invention, the paper tray further includes a second slide shaft, wherein the second slide shaft is connected to the paper tray body, and is parallel to the first slide shaft. The first pick arm is pivotally connected to the second slide shaft, and the first pick roller in the first pick arm is rotated along with the second slide shaft. The second pick arm is slidely and pivotally connected to the second slide shaft, and the second pick roller in the second pick arm is rotated along with the second slide shaft.

In an embodiment of the present invention, the first slide shaft and the second slide shaft are polygon shaft levers or rounded shaft levers having grooves.

In an embodiment of the present invention, the second slide shaft has a groove, and the first pick arm has a first buckle gear buckled in the groove, so as to drive the first pick roller in the first pick arm to rotate along with the second slide shaft. The second pick arm has a second buckle gear slidely buckled in the groove, so as to drive the second pick roller in the second pick arm to rotate along with the second slide shaft.

In an embodiment of the present invention, the linkage device is a connecting structure directly connected between the paper width guide and the second pick arm. The paper width guide drives the second pick arm to slide along the first and the second slide shafts through the linkage device.

In an embodiment of the present invention, the linkage device includes a pulley set and a linkage cable. The pulley set has a plurality of pulleys disposed in the paper tray body. The linkage cable is disposed on the pulleys and is fixed on the paper width guide and the second pick arm. The paper width guide drives the second pick arm to slide along the first and the second slide shafts through the linkage cable.

In an embodiment of the present invention, the linkage device includes a plurality of position sensors, a linkage lever, a motor and a controller. The position sensors are disposed on the paper tray body for sensing a position of the paper width guide. The linkage lever is disposed on the paper tray body, and the second pick arm is pivotally connected to the linkage lever. The motor is used for driving the linkage lever to drive the second pick arm to slide along the first and the second slide shafts. The controller is coupled between the position sensors and the motor, and drives the motor according to a position of the paper width guide, so as to drive the second pick arm.

In an embodiment of the present invention, the paper width guide adjusts a position of the second pick arm in a same direction, so that the second pick arm is moved along a moving direction of the paper width guide.

The present invention provides a paper tray of a printer, which includes a paper tray body, a slide shaft, a first pick arm, a second pick arm and a paper width guide. The slide shaft is connected to the paper tray body. The first pick arm has a first pick roller and is pivotally connected to the slide shaft, wherein the first pick roller in the first pick arm is rotated along with the slide shaft. The second pick arm has a second paper roller and is slidely and pivotally disposed on the slide shaft, wherein the second pick roller in the second pick arm is rotated along with the slide shaft. The paper width guide is disposed on the paper tray body and is connected to the second pick arm through a linkage device to drive the second pick arm.

As described above, in the present invention, two pick arms are configured in the paper tray of the printer, and an interval between the pick arms can be automatically adjusted according to a movement of the paper width guide, so that the positions of the pick arms can be automatically adjusted according to the size of the paper. Therefore, during a paper feeding process of the printer, a problem of paper skew caused by uneven force exerted on the paper due to the single pick arm can be avoided.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

First Embodiment

Figure 1:
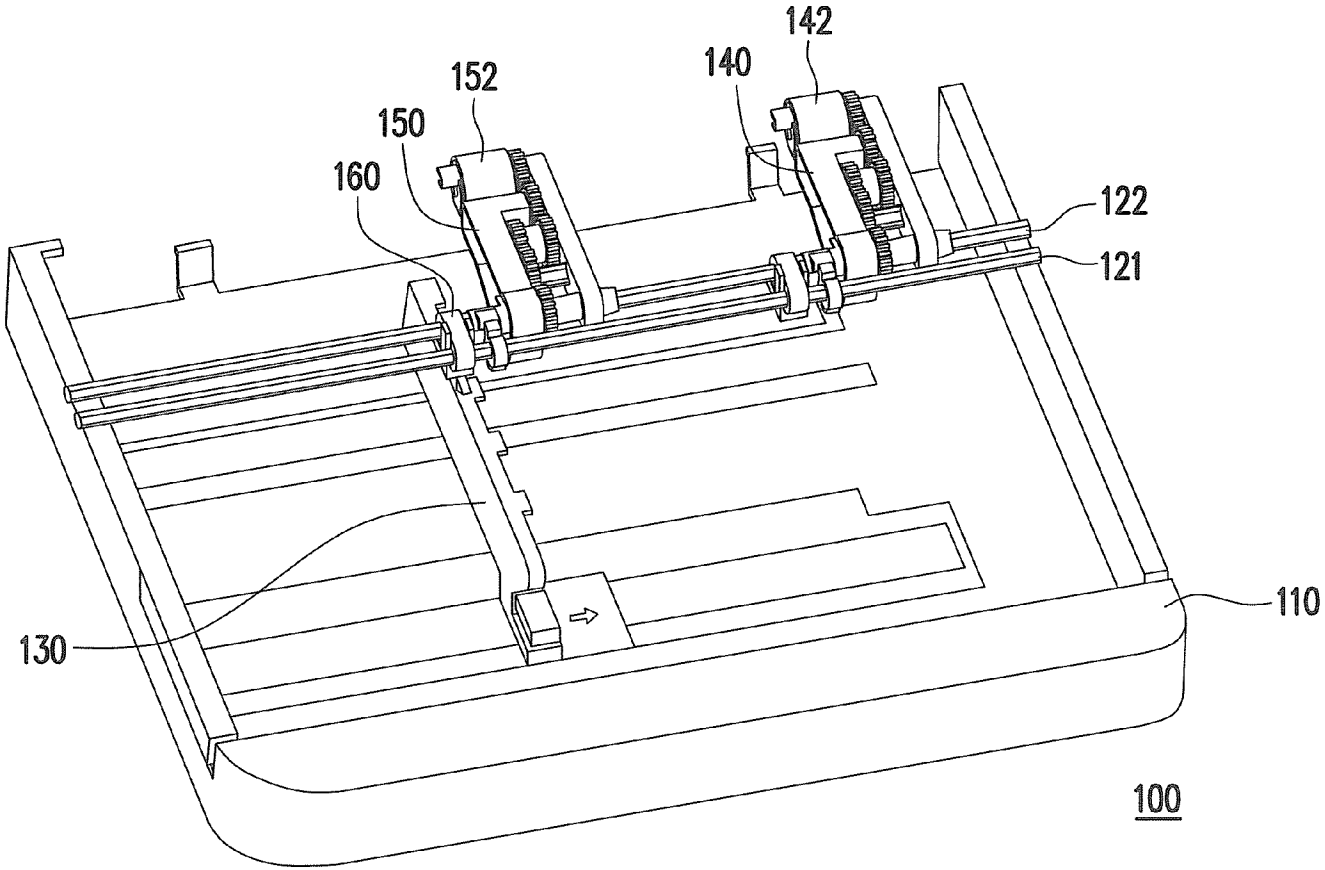
FIG. 1 is a diagram illustrating a paper tray of a printer according to a first embodiment of the present invention.

Referring to FIG. 1, FIG. 1 is a diagram illustrating a paper tray of a printer according to a first embodiment of the present invention. The paper tray 100 includes a paper tray body 110, a first slide shaft 121, a second slide shaft 122, a first pick arm 140, a second pick arm 150, and a paper width guide 130. The first pick arm 140 has a first pick roller 142 and a gear set for driving the first pick roller 142. The second pick arm 150 has a second pick roller 152 and a gear set for driving the second pick roller 152. A connecting structure 160 is connected between the paper width guide 130 and the second pick arm 150. The first slide shaft 121 and the second slide shaft 122 are parallel and are connected to the paper tray body 110. The first pick arm 140 is fixed on the first slide shaft 121, and is pivotally connected to the second slide shaft 122, and the first pick roller 142 in the first pick arm 140 can be rotated along with the second slide shaft 122. The second pick arm 150 is slidely and pivotally connected to the first slide shaft 121 and the second slide shaft 122. The second pick arm 150 can be slid along the first slide shaft 121 and the second slide shaft 122, and the second pick roller 152 in the second pick arm 150 can be rotated along with the second slide shaft 122.

Horizontal angles of the first pick arm 140 and the second pick arm 150 can be adjusted according to the first slide shaft 121 and the second slide shaft 122, so that the first pick roller 142 and the second pick roller 152 can lean against a paper for driving the paper. The second slide shaft 122 can drive the first pick roller 142 and the second pick roller 152 to rotate, so as to drive the paper. Wherein, a position of the first pick arm 140 is fixed, and the second pick arm 150 can be slid along the first slide shaft 121 and the second slide shaft 122 to adjust a position thereof.

The paper width guide 130 is disposed on the paper tray body 110 and is connected to the second pick arm 150 through a linkage device for driving the second pick arm 150, so that a position of the second pick arm 150 is adjusted as the paper width guide 130 is moved. In the present embodiment, the linkage device is the connecting structure 160, and the paper width guide 130 is directly connected to the second pick arm 150 through the connecting structure 160, so that the second pick arm 150 can be moved along with a movement of the paper width guide 130. When the position of the paper width guide 130 is adjusted according to the paper width, the second pick arm 150 is accordingly slid to adjust the position thereof, so that an interval between the first pick arm 140 and the second pick arm 150 can fit a size of the paper. Namely, the second pick arm 150 is moved along a moving direction of the paper width guide 130, and is automatically adjusted to a corresponding position. Since the first pick arm 140 and the second pick arm 150 are respectively located at two sides of the paper, forces exerted on the paper can be even, so that when the paper is fed, a problem of paper skew can be mitigated.

Figure 2:
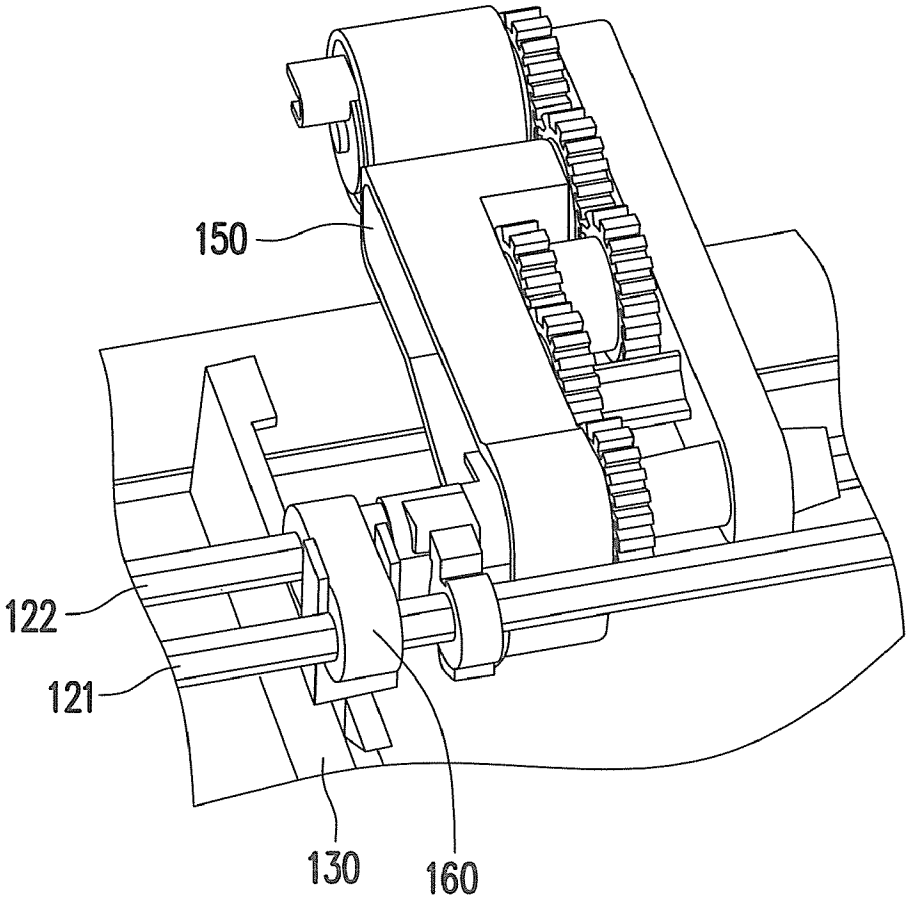
FIG. 2 is a partial amplified diagram of a paper tray according to a first embodiment of the present invention.

A detailed structure of the connecting structure 160 is shown in FIG. 2. FIG. 2 is a partial amplified diagram of the paper tray according to the first embodiment of the present invention. As shown in FIG. 2, the connecting structure 160 is connected between the paper width guide 130 and the second pick arm 150, and the first slide shaft 121 and the second slide shaft 122 are pivoted therein. Similarly, the connecting structure 160 is also disposed on the paper width guide 130, so that the paper width guide 130 can drive the second pick arm 150 to slide along the first slide shaft 121 and the second slide shaft 122.

Figure 3:
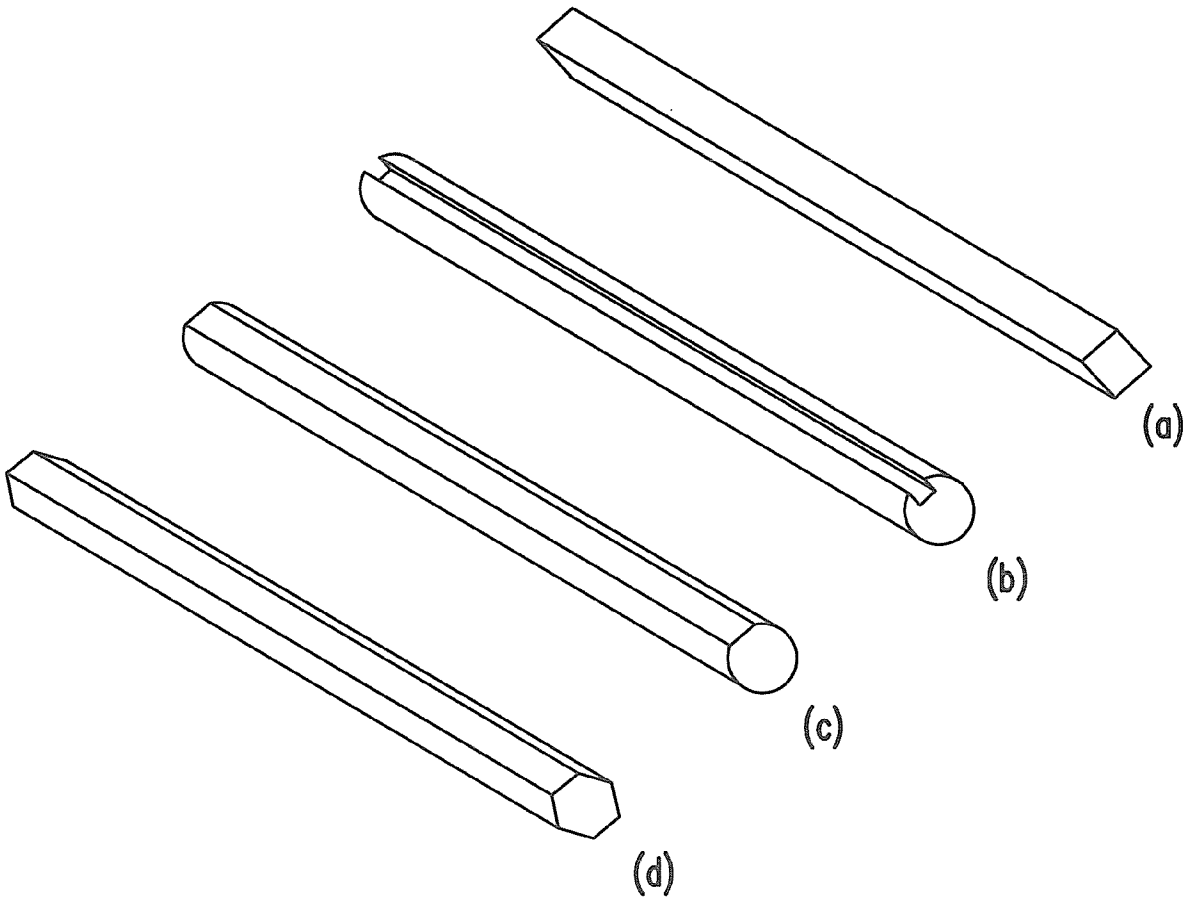
FIG. 3 is a structural diagram illustrating shaft levers of a second slide shaft 122 according to a first embodiment of the present invention.
Figure 13A:
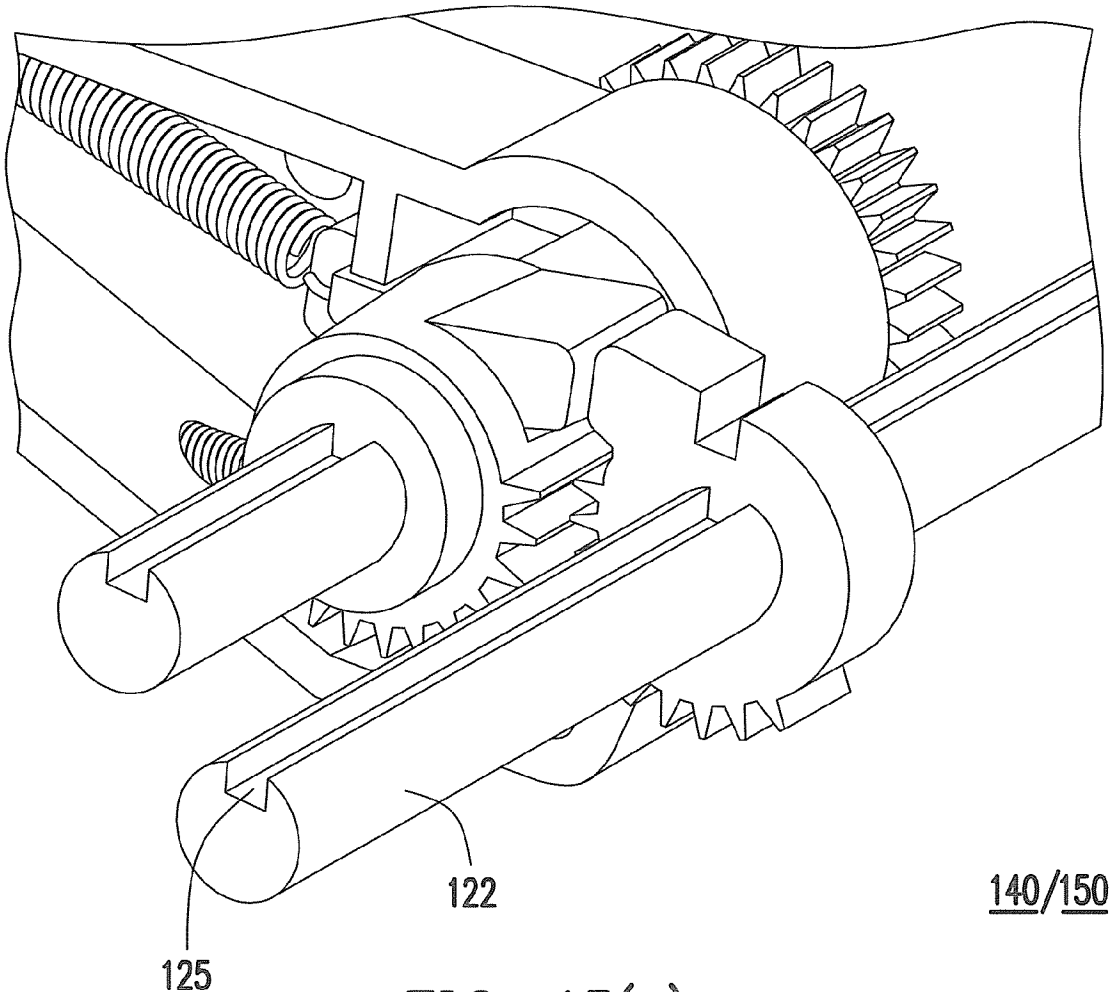
FIGS. 13(*a*) and 13(*b*) show the first and second pick arms 140 and 150 corresponding to FIG. 3(*b*) according to one embodiment of the present invention.
Figure 13B:
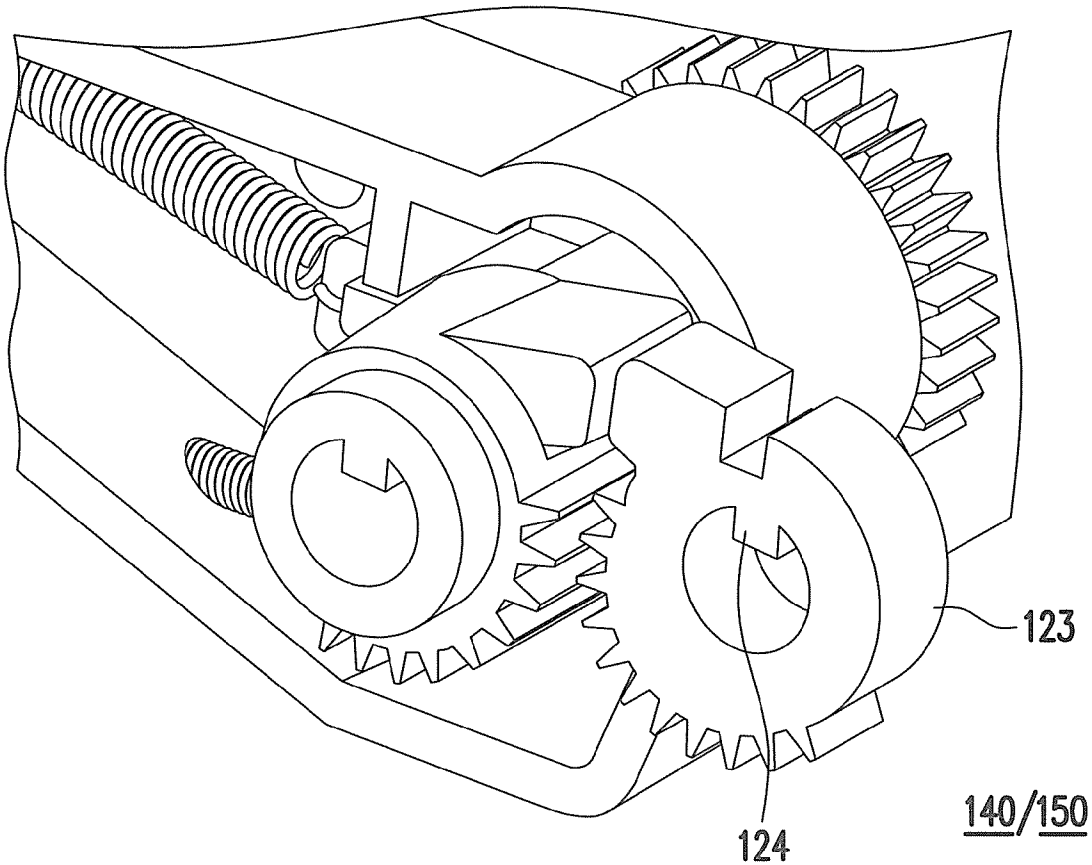

Moreover, it should be noticed that to ensure the second pick arm 150 can be slid along the second slide shaft 122, and the second slide shaft 122 can drive the second pick roller 152 in the second pick arm 150, the second slide shaft 122 can be implemented by a non-rounded shaft lever. Referring to FIG. 3, FIG. 3 is a structural diagram illustrating shaft levers of the second slide shaft 122 according to the first embodiment of the present invention. Wherein, the shaft levers illustrated in FIG. 3(*a*), FIG. 3(*c*) and FIG. 3(*d*) are polygon shaft levers, and the shaft lever illustrated in FIG. 3(*b*) is a rounded shaft lever having a groove 125 (please further refer to FIGS. 13(*a*) and 13(*b*)), according which corresponding buckle gears 123 can be configured in the first pick arm 140 and the second pick arm 150, and inner rings of the buckle gears 123 may have buckle fasteners 124 for buckling in the groove 125. Therefore, the second pick arm 150 can be slid along the second slide shaft 122, and the first pick roller 142 and the second pick roller 152 can be driven by a rotation of the second slide shaft 122.

Second Embodiment

Figure 4:
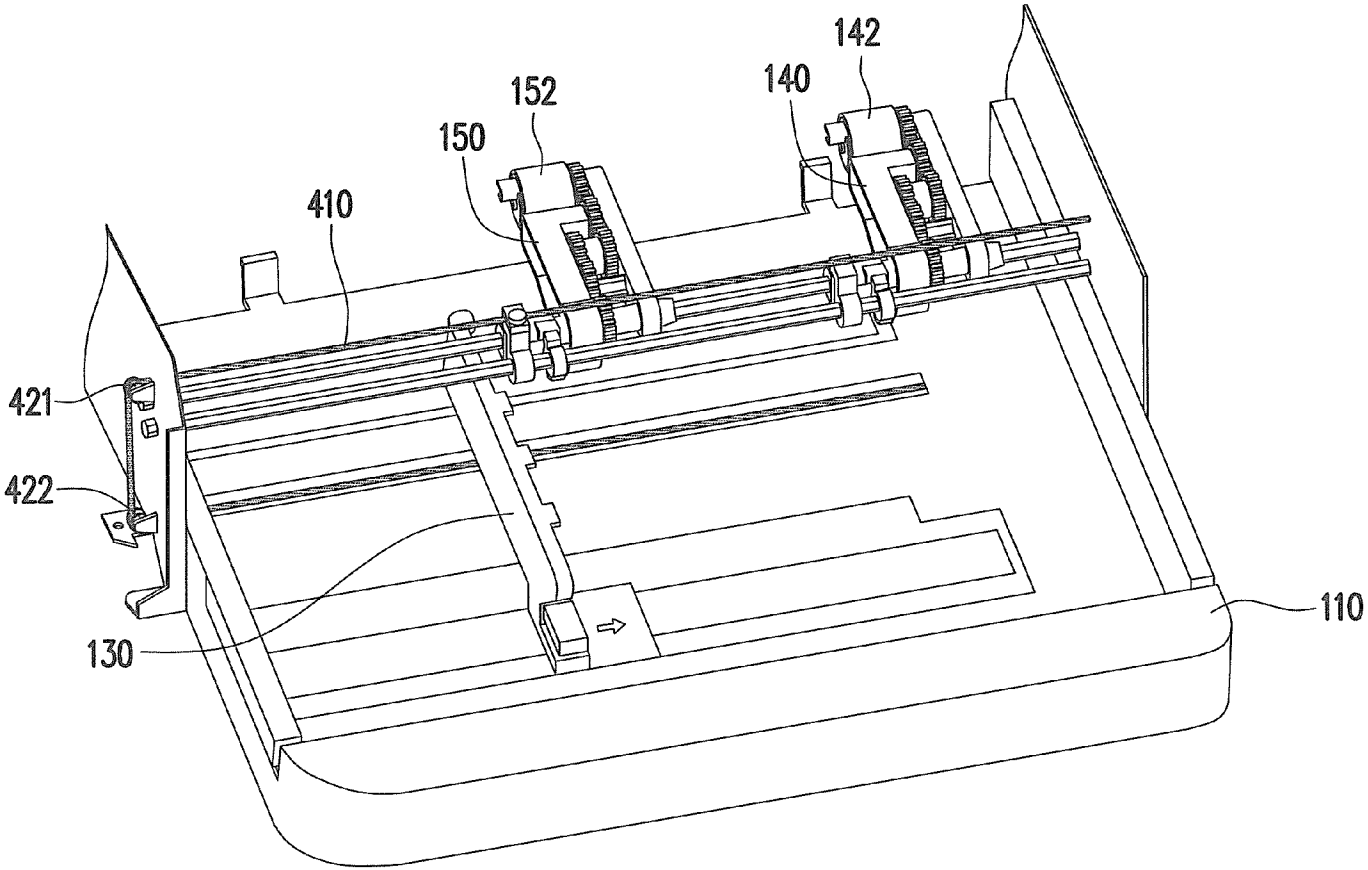
FIG. 4 is a diagram illustrating a paper tray of a printer according to a second embodiment of the present invention.

Besides the aforementioned connecting structure 160, the paper width guide 130 can also drive the second pick arm 150 through another linkage device. Referring to FIG. 4, FIG. 4 is a diagram illustrating a paper tray of a printer according to a second embodiment of the present invention. A main difference between the embodiments of FIG. 4 and FIG. 1 is the linkage device connected between the paper width guide 130 and the second pick arm 150. In the present embodiment, the paper width guide 130 drives the second pick arm 150 through a pulley set (including pulleys 421 and 422) and a linkage cable 410. The linkage cable 410 is disposed on the pulley set and is fixed to the paper width guide 130 and the second pick arm 150. When the paper width guide 130 is moved, the paper width guide 130 drives the second pick arm 150 through the linkage cable 410 and the pulley set. The linkage cable 410 is, for example, a metal wire.

Figure 5:
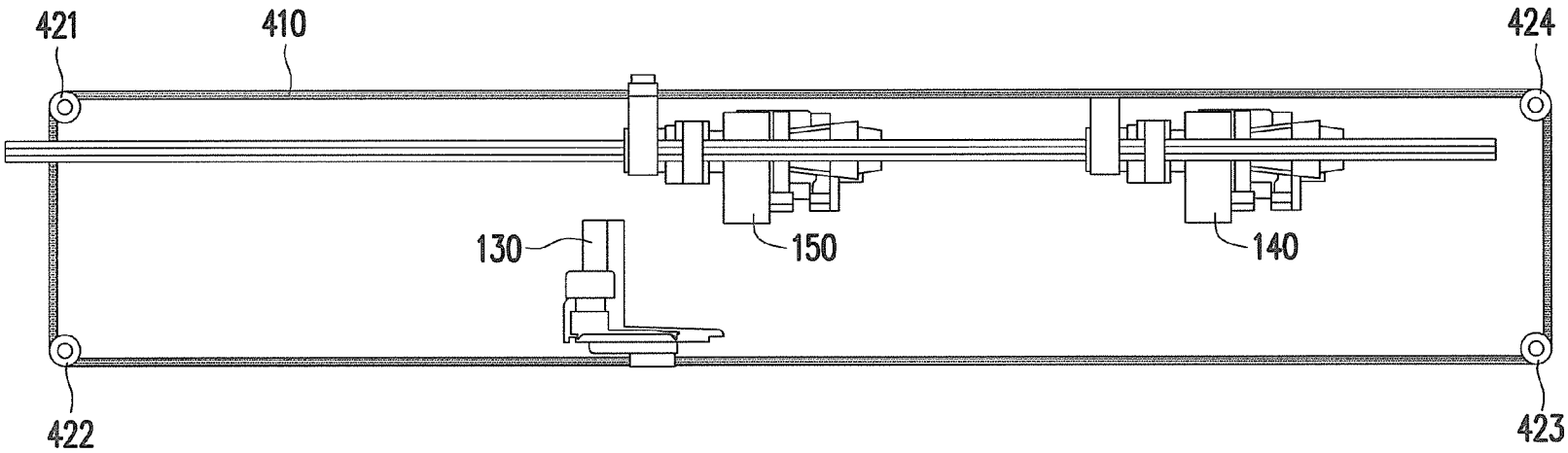
FIG. 5 is a diagram illustrating a linkage device according to a second embodiment of the present invention.
Figure 6:
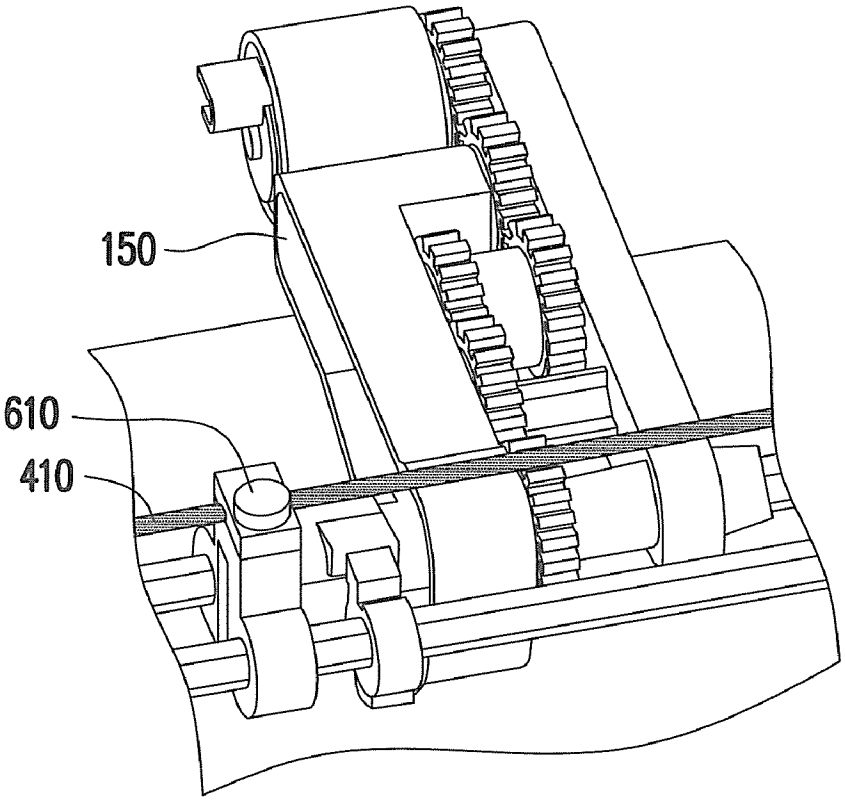
FIG. 6 and FIG. 7 are partial diagrams of a linkage device according to a second embodiment of the present invention.
Figure 7:
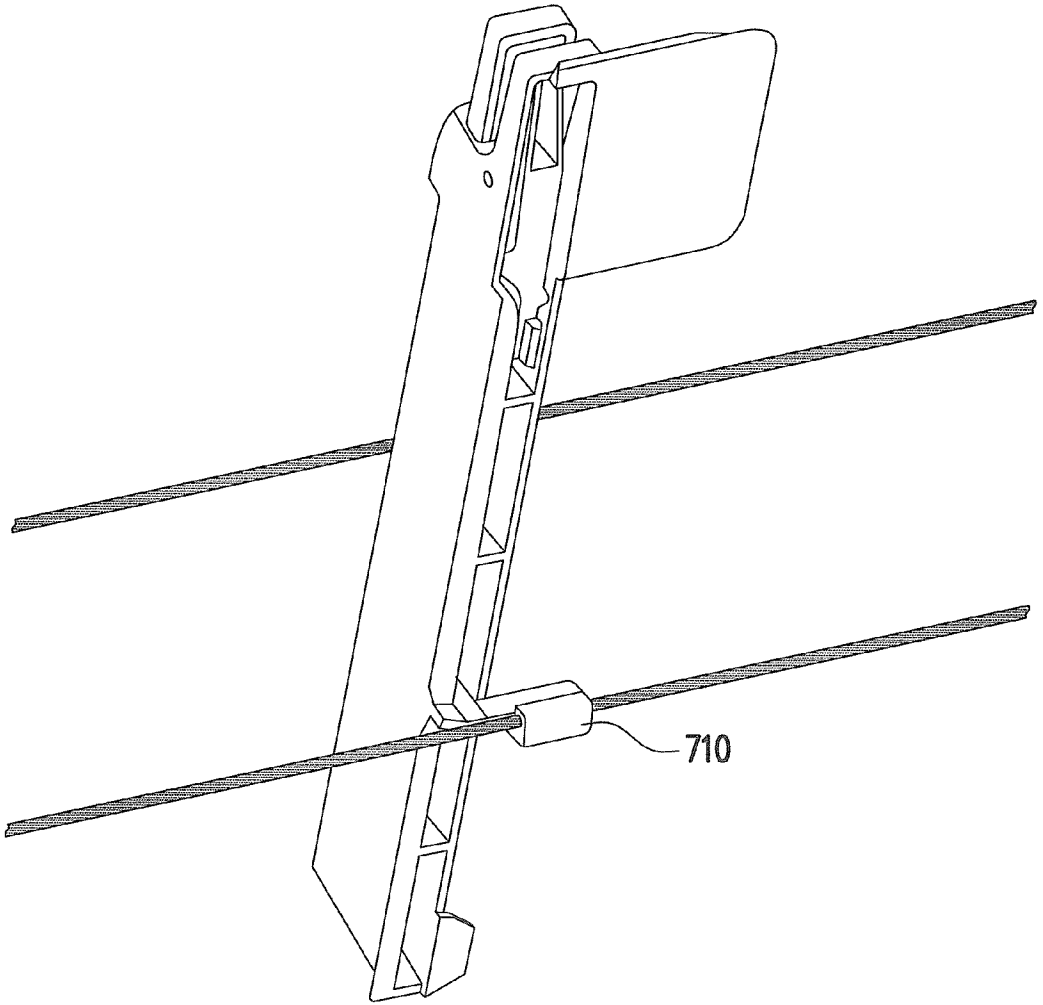

Coupling relations of the paper width guide 130, the second pick arm 150, the pulley set and the linkage cable 410 are as that shown in FIG. 5. FIG. 5 is a diagram illustrating the linkage device according to the second embodiment of the present invention. As shown in FIG. 5, the pulley set includes pulleys 421, 422, 423 and 424, and the linkage cable 410 is disposed on the pulley set, and is fixed to the second pick arm 150 and fixed underneath the paper width guide 130. When the paper width guide 130 is moved, the second pick arm 150 is pulled via the linkage cable 410, so that the second pick arm 150 is slid to a corresponding position along a moving direction of the paper width guide 130. FIG. 6 and FIG. 7 are partial diagrams of the linkage device according to the second embodiment of the present invention. According to FIG. 6, the linkage cable 410 can be fixed to the second pick arm 150 through a lock member 610, though a structure and a fixing approach thereof are not limited by the present invention. FIG. 7 illustrates relative positions of the linkage cable 410 and the paper width guide 130. A part of the linkage cable 410 is fixed to a clip member 710 located underneath the paper width guide 130, and another part of the linkage cable 410 is detoured to the top of the paper width guide 130 through the pulley set, and is connected to the second pick arm 150. A connecting approach between the linkage cable 410 and the paper width guide 130 can be implemented by a clipping or a locking approach, which is not limited by the present invention.

Third Embodiment

Figure 8:
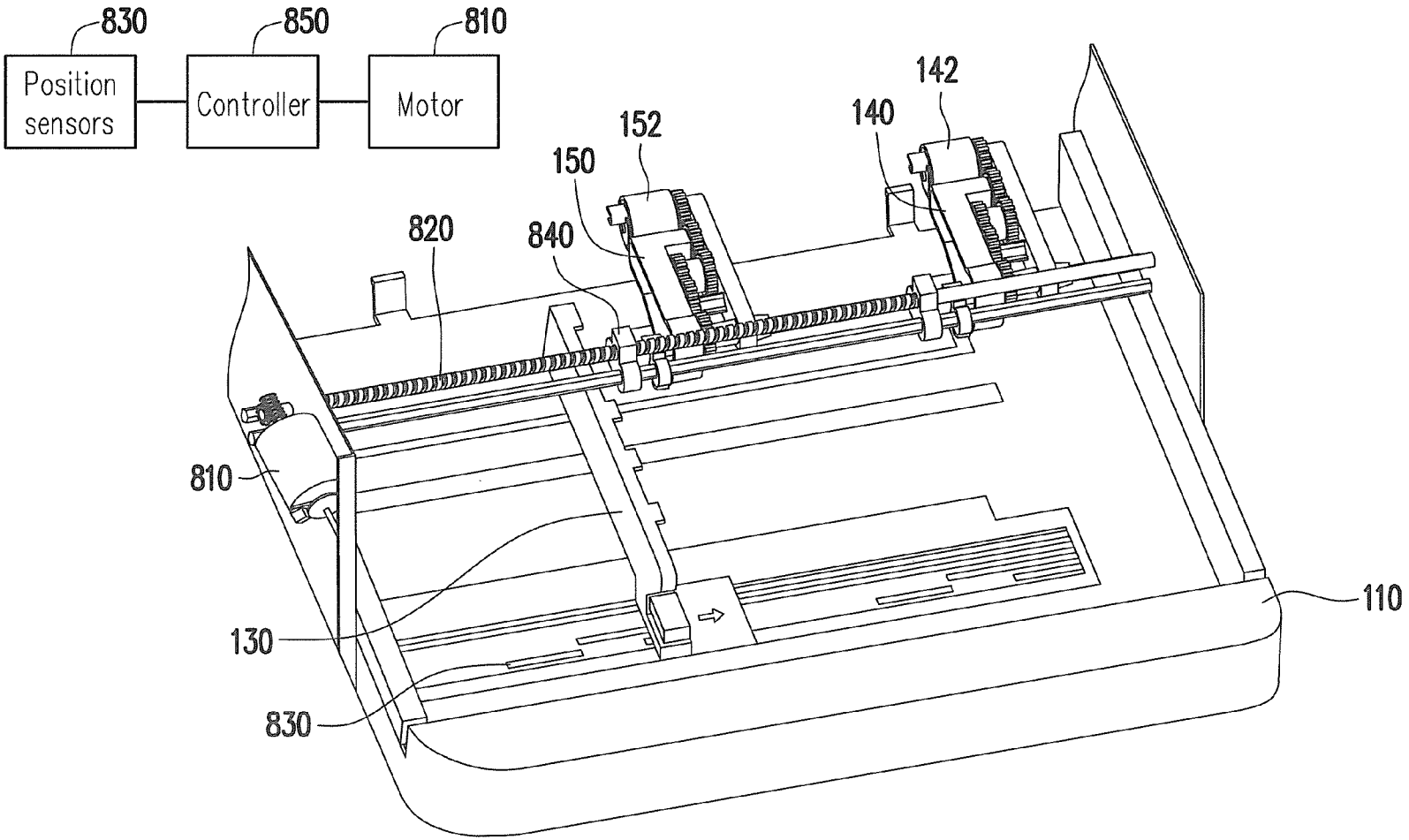
FIG. 8 is a diagram illustrating a paper tray of a printer according to a third embodiment of the present invention.

Besides the first embodiment and the connecting structure of the first embodiment, the paper width guide 130 can also drive the second pick arm 150 through another linkage device. Referring to FIG. 8, FIG. 8 is a diagram illustrating a paper tray of a printer according to a third embodiment of the present invention. Wherein, the paper width guide 130 drives the second pick arm 150 through a motor 810 and a linkage lever 820. A plurality of position sensors 830 is disposed underneath the paper width guide 130 for sensing a position of the paper width guide 130. After a controller 850, coupled between the position sensors 830 and the motor 810, obtains a position variation of the paper width guide 130 through the position sensors 830, the controller 850 directly controls the motor 810 to rotate, so as to drive the second pick arm 150. The linkage lever 820 can be designed in a spiral shape, and a corresponding connecting structure 840 can be configured on the second pick arm 150 for covering the linkage lever 820. When the linkage lever 820 is rotated, the second pick arm 150 is accordingly driven.

Figure 9:
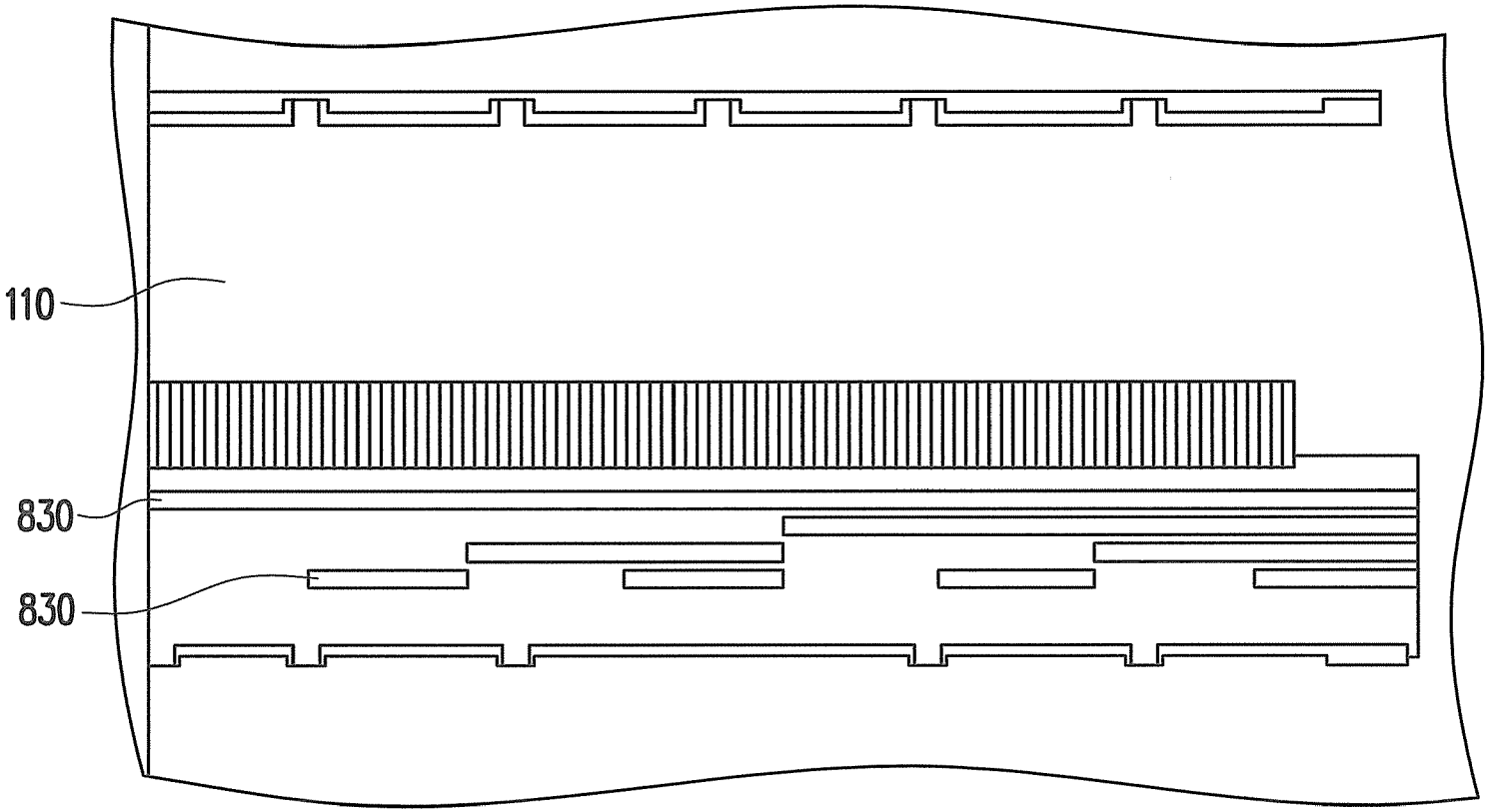
FIG. 9 is a configuration diagram of position sensors 830 according to a third embodiment of the present invention.

Configuration of the position sensors 830 is as that shown in FIG. 9. FIG. 9 is a configuration diagram of the position sensors 830 according to the third embodiment of the present invention. As shown in FIG. 9, the position sensors 830 are disposed on the paper tray body 110, and are located below the paper width guide 130. The position sensors 830 can be implemented by pressure sensors, touch sensors or optical sensors, which are not limited by the present invention. When the paper width guide 130 is moved, the position sensors 830 transmit a sensing signal to the controller 850, and the controller 850 accordingly controls the motor 810 to rotate. The controller 850 can be implemented by an embedded chip or a control unit in the printer, or an independent embedded chip can be additionally configured to implement the controller 850, which is not limited by the present invention.

Figure 10:
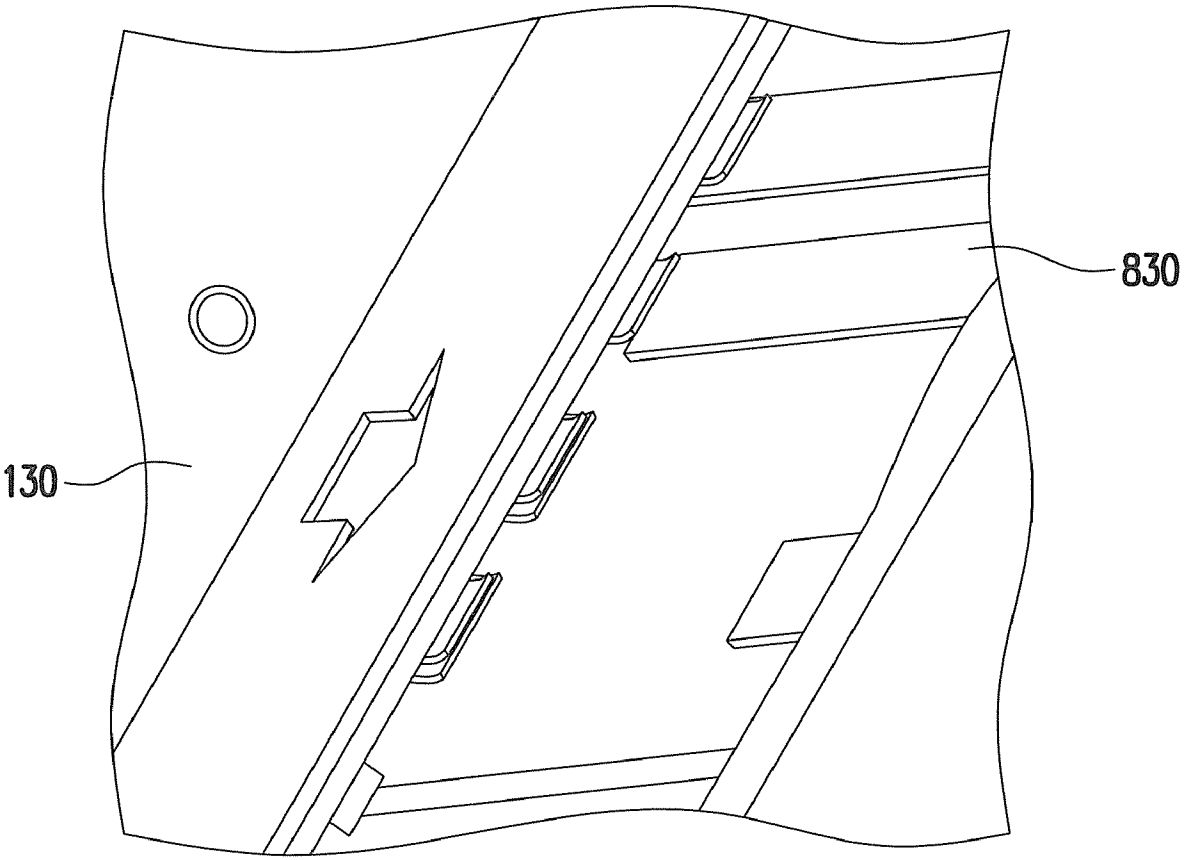
FIG. 10 is a partial diagram illustrating position sensors 830 and a paper width guide 130.
Figure 11:
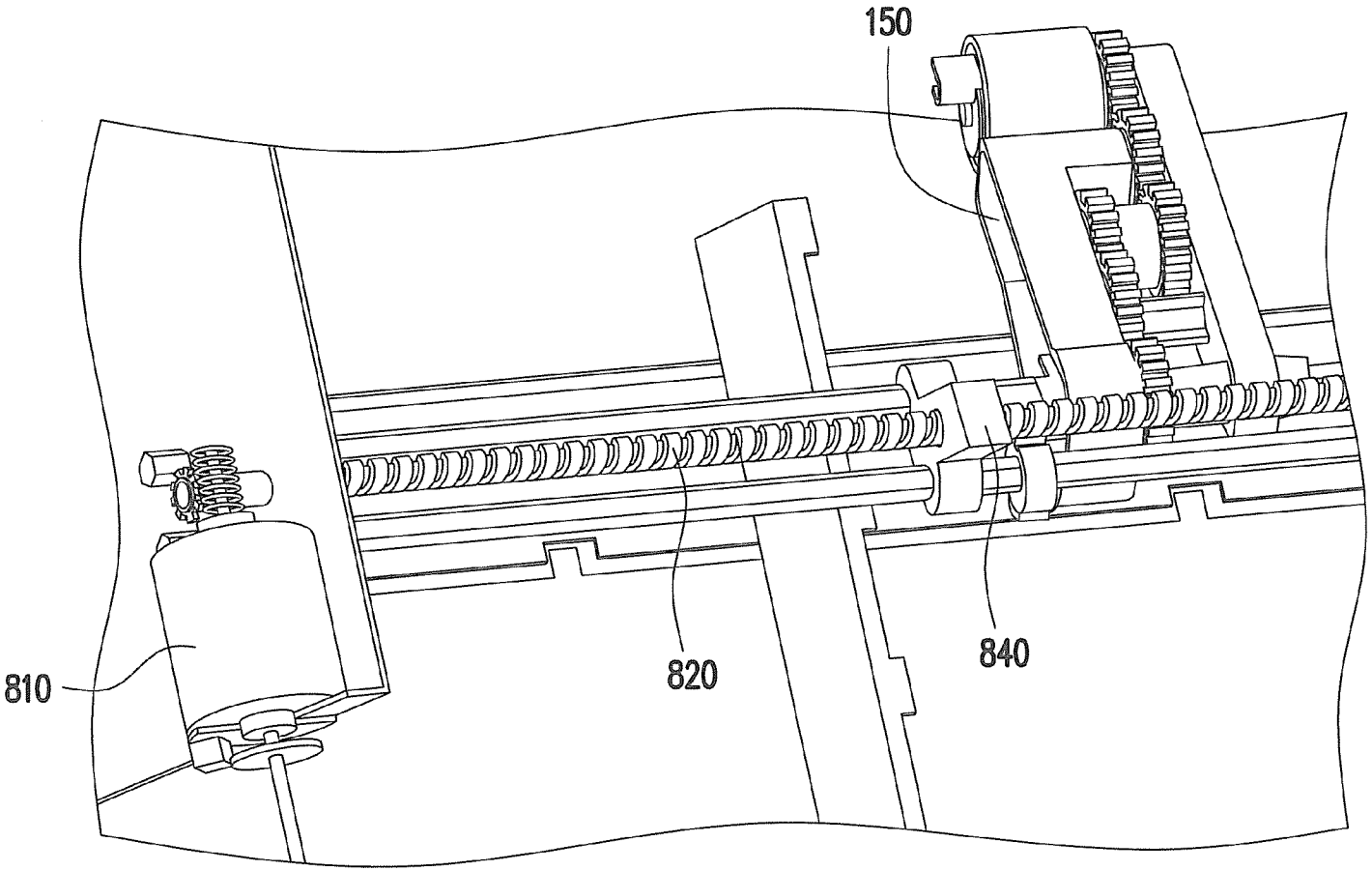
FIG. 11 is a partial diagram illustrating a motor 810 and a linkage lever 820 of a third present embodiment.

FIG. 10 is a partial diagram illustrating the position sensors 830 and the paper width guide 130. Referring to FIG. 10, the paper width guide 130 is disposed above the position sensors 830, and when the paper width guide 130 is moved, the position sensors 830 can detect the position of the paper width guide 130 and output a corresponding sensing signal. FIG. 11 is a partial diagram illustrating the motor 810 and the linkage lever 820 of the present embodiment. The motor 810 is connected to the linkage lever 820 through a gear, and drives the second pick arm 150 through the connecting structure 840 connected to the second pick arm 150. The connecting structure 840 covers the linkage lever 820 and has corresponding threads, so that the connecting structure 840 can be moved along with the linkage lever 820.

In the above embodiments, the paper tray having two pick arms 140 and 150 is disclosed, wherein the second pick arm 150 can be moved along with a movement of the paper width guide 130. The paper width guide 130 drives the first pick arm 150 to move along a same direction, i.e. the interval between the two pick arms 140 and 150 can be varied along with the size of the paper, so as to mitigate the problem of paper skew during the paper feeding. The paper width guide 130 can drive the second pick arm 150 through the linkage device, and implementations of the linkage device connected between the paper width guide 130 and the second pick arm 150 at least include the aforementioned approaches of the connecting structure 160, the cable driving and the motor driving, etc., though the present invention is not limited thereto, and those have ordinary skill in the art can deduce other implementations thereof according to the disclosure of the present invention, which is not limited by the present invention. Moreover, the technical approaches of the present invention can be applied to various electronic devices requiring the paper trays, for example, electronic devices such as, multi function printers (MFP) or photocopiers, etc. having the printing function, so that the present invention is not limited to a pure printer.

Fourth Embodiment

Figure 12:
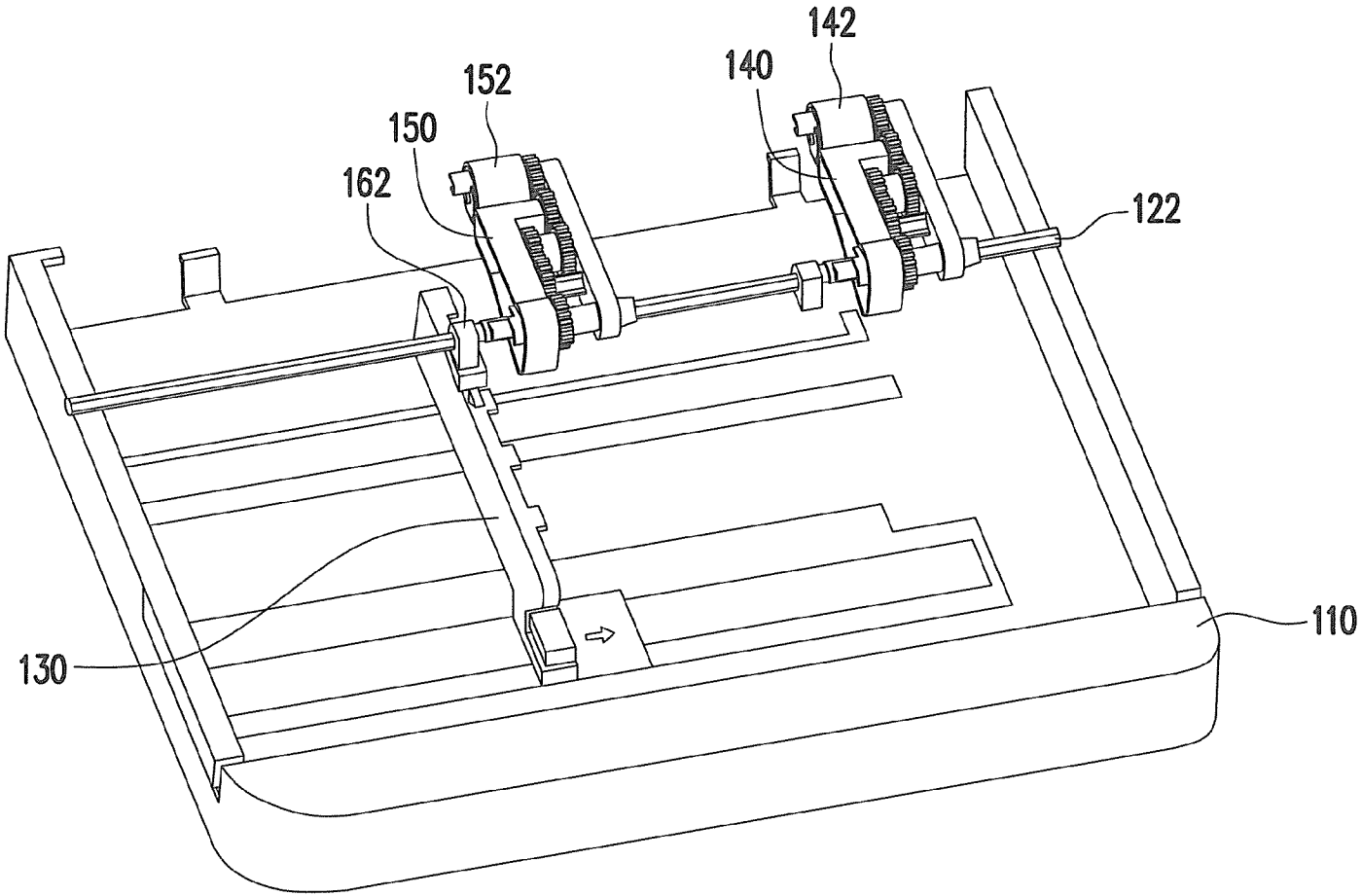
FIG. 12 is a diagram illustrating a paper tray of a printer according to a fourth embodiment of the present invention.

In the above embodiments, though two slide shafts are used to describe the technical approaches of the present invention, the present invention can also be adapted to the paper tray having a single slide shaft. Referring to FIG. 12, FIG. 12 is a diagram illustrating a paper tray of a printer according to a fourth embodiment of the present invention. A main difference between the embodiments of FIG. 12 and FIG. 1 is that the paper tray of FIG. 12 only has the second slide shaft 122, wherein the first pick arm 140 and the second pick arm 150 are pivotally connected to the second slide shaft 122, and the first pick roller 142 and the second pick roller 152 in the first pick arm 140 and the second pick arm 150 can be driven by the second slide shaft 122. A spin-down function of the first pick arm 140 and the second pick arm 150 is similar to an automatic document feeder (ADF) using friction to drive the rotation.

Wherein, a position of the second pick arm 150 can be adjusted along with a movement of the paper width guide 130, and the paper width guide 130 is connected to the second pick arm 150 through a connecting structure 162. Implementations of the linkage device between the paper width guide 130 and the second pick arm 150 also include the aforementioned approaches of the connecting structure, the cable driving and the motor driving, etc. According to the disclosure of the present invention, those with ordinary skill in the art can deduce that the technical approaches of the first to the third embodiments can be applied to the paper tray of a single slide shaft, so that detailed description thereof is not repeated.

In summary, in the present invention, two sets of pick arms are configured in the paper tray of the printer, and the interval between the pick arms can be automatically adjusted according to a movement of the paper width guide, so as to fit the paper of different sizes. Therefore, during a paper feeding process of the printer, the problem of paper skew can be avoided, and meanwhile the problem of paper jam of the printer is also avoided.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A paper tray of a printer, comprising:

a paper tray body;

a slide shaft, connected to the paper tray body;

a first pick arm, having a first pick roller, pivotally connected to the slide shaft, and the first pick roller in the first pick arm being rotated along with the slide shaft;

a second pick arm, having a second paper roller, slidely and pivotally disposed on the slide shaft, and the second pick roller in the second pick arm being rotated along with the slide shaft; and a paper width guide, disposed on the paper tray body, and connected to the second pick arm through a linkage device to drive the second pick arm, wherein the linkage device comprises:

a plurality of position sensors, disposed on the paper tray body for sensing a position of the paper width guide;

a linkage lever, disposed on the paper tray body, and the second pick arm being pivotally connected to the linkage lever;

a motor, driving the linkage lever to drive the second pick arm to slide along the slide shaft; and a controller, coupled between the position sensors and the motor, and driving the motor according to a position of the paper width guide, so as to drive the second pick arm.

2. The paper tray of the printer as claimed in claim 1, wherein the slide shaft is a polygon shaft lever.

3. The paper tray of the printer as claimed in claim 1, wherein the slide shaft has a groove, and the first pick arm has a first buckle gear buckled in the groove, so as to drive the first pick roller in the first pick arm to rotate along with the slide shaft; and the second pick arm has a second buckle gear slidely buckled in the groove, so as to drive the second pick roller in the second pick arm to rotate along with the slide shaft.

4. The paper tray of the printer as claimed in claim 1, wherein the paper width guide adjusts a position of the second pick arm in a same direction, so that the second pick arm is moved along a moving direction of the paper width guide.

5. The paper tray of the printer as claimed in claim 1, wherein linkage lever is designed in a spiral shape, and a corresponding a connecting structure is configured on the second pick am for covering the linkage lever, such that when the linkage lever is rotated, the second pick arm is accordingly driven.

6. The paper tray of the printer as claimed in claim 1, wherein the position sensors are further located below the paper width guide.

7. The paper tray of the printer as claimed in claim 1, wherein the position sensors are implemented by pressure sensors, touch sensors or optical sensors.

8. The paper tray of the printer as claimed in claim 1, wherein the controller is a control core of the printer, or is an additional independent embedded chip.

* * * * *